US008833437B2

(12) United States Patent
Singh et al.

(10) Patent No.: US 8,833,437 B2
(45) Date of Patent: Sep. 16, 2014

(54) HEAT EXCHANGER APPARATUS FOR CONVERTING A SHELL-SIDE LIQUID INTO A VAPOR

(75) Inventors: Krishna P. Singh, Jupiter, FL (US); Ranga Nadig, Cherry Hill, NJ (US)

(73) Assignee: Holtec International, Inc.

( * ) Notice: Subject to any disclaimer, the term of this patent is extended or adjusted under 35 U.S.C. 154(b) by 702 days.

(21) Appl. No.: 12/774,962

(22) Filed: May 6, 2010

(65) Prior Publication Data

US 2010/0282448 A1 Nov. 11, 2010

Related U.S. Application Data

(60) Provisional application No. 61/175,956, filed on May 6, 2009.

(51) Int. Cl.

| | |
|---|---|
| ***F28D 7/06*** | (2006.01) |
| ***F22B 37/26*** | (2006.01) |
| ***F22B 1/00*** | (2006.01) |
| ***F28F 9/24*** | (2006.01) |
| ***F22B 1/16*** | (2006.01) |
| ***F22B 37/30*** | (2006.01) |
| *F28F 9/013* | (2006.01) |
| *F28F 13/06* | (2006.01) |
| *F28F 9/22* | (2006.01) |

(52) U.S. Cl.

CPC . *F28D 7/06* (2013.01); *F22B 1/006* (2013.01); *F28F 9/24* (2013.01); *F28F 2270/00* (2013.01); *F28F 9/0131* (2013.01); *F28F 13/06* (2013.01); *F28F 2009/222* (2013.01); *F22B 1/165* (2013.01); *F22B 1/167* (2013.01); *F22B 37/30* (2013.01)

USPC ..... 165/129; 165/111; 165/135; 165/160; 165/161; 122/488; 122/491

(58) Field of Classification Search

CPC ..... F22B 1/006; F22B 37/26; F22B 37/30; F22B 37/34; F22D 7/00

USPC ..... 165/160, 161, 135, 129, 111; 122/488, 122/491

See application file for complete search history.

(56) References Cited

U.S. PATENT DOCUMENTS 1,845,540 A * 2/1932 Smith ..... 165/161
2,084,743 A * 6/1937 Rathbun ..... 165/161

(Continued)

FOREIGN PATENT DOCUMENTS

EP 0743499 11/1996

*Primary Examiner* — Leonard R Leo
(74) *Attorney, Agent, or Firm* — The Belles Group, P.C.

(57) ABSTRACT

An apparatus for generating steam within a heat exchanger. In one aspect, the invention can be a heat exchanger comprising: a shell having an inner surface forming a cavity, the shell comprising an inlet for introducing the shell-side liquid into the cavity and an outlet for allowing the vapor to exit the cavity; a tube bundle comprising a plurality of tubes for carrying a tube-side fluid located in the cavity and having a longitudinal axis; a shroud circumferentially surrounding the tube bundle and positioned between the tube bundle and the inner surface of the shell so that an annular space exists between the shroud and the inner surface; an opening in a bottom portion of the shroud that forms a passageway between the annular space and the tube bundle; and an opening in a top portion of the shroud that forms a passageway between the annular space and the tube bundle.

22 Claims, 10 Drawing Sheets

(56) References Cited

U.S. PATENT DOCUMENTS

| | | | | | |
|---|---|---|---|---|---|
| 2,091,757 | A | * | 8/1937 | Hanny | 165/161 |
| 3,048,373 | A | * | 8/1962 | Bauer et al. | 165/161 |
| 3,326,280 | A | * | 6/1967 | Bosquain et al. | 165/161 |
| 4,049,048 | A | | 9/1977 | Leedham | |
| 4,137,964 | A | * | 2/1979 | Buckley | 165/104.19 |
| 4,298,058 | A | | 11/1981 | Wochele | |
| 4,685,509 | A | * | 8/1987 | Koeller | 165/160 |
| 4,699,211 | A | | 10/1987 | Geary et al. | |
| 5,699,395 | A | | 12/1997 | Sylvester et al. | |
| 5,704,422 | A | * | 1/1998 | Chess et al. | 165/160 |
| 6,619,042 | B2 | | 9/2003 | Nadig | |
| 7,967,946 | B2 | * | 6/2011 | Ling | 165/161 |
| 2005/0150640 | A1 | | 7/2005 | Nadig | |
| 2005/0161204 | A1 | * | 7/2005 | Johnston et al. | 165/162 |
| 2008/0302520 | A1 | | 12/2008 | Bhattacharyya et al. | |
| 2008/0314570 | A1 | | 12/2008 | Singh et al. | |
| 2009/0198092 | A1 | | 8/2009 | Singh et al. | |

* cited by examiner

HEAT EXCHANGER APPARATUS FOR CONVERTING A SHELL-SIDE LIQUID INTO A VAPOR

CROSS-REFERENCE TO RELATED APPLICATIONS

The present application claims the benefit of U.S. Provisional Patent Application Ser. No. 61/175,956, filed on May 6, 2009, the entirety of which is hereby incorporated by reference.

FIELD OF THE INVENTION

The present invention relates generally to a method, system and/or apparatus for converting a shell-side liquid into a vapor, and specifically to a heat exchanger apparatus, system and/or method for generating steam from a non-polluting energy source, such as the sun or nuclear fission, and using the steam for power generation.

BACKGROUND OF THE INVENTION

Existing heat exchangers generally comprise a shell (a large vessel) having a bundle of tubes (commonly referred to as a tube bundle) positioned within a cavity of the shell. Two fluids of different starting temperatures flow through the heat exchanger. One fluid, known as the tube-side fluid, flows inside of the tubes of the tube bundle. A second fluid, known as the shell-side fluid, flows through the cavity of the shell on the outside of the tubes. The fluids may both be liquids or they may both be gases. Alternatively, one of the fluids may be a gas while the other fluid is a liquid. During operation of a typical heat exchanger, heat is transferred between the two fluids without direct contact between the two fluids. Specifically, heat is transferred from the hotter fluid, through the walls of the tubes, and into the cooler fluid. The transfer of heat without contact between the shell-side fluid and the tube-side fluid is particularly desirable in the nuclear power plant industry because the primary or secondary fluids may become radioactive. Depending upon the fluids used and the desired results, heat is transferred either from the tube-side fluid to the shell-side fluid, or vice versa.

A typical solar power plant uses a preheater, a steam generator and a superheater to produce steam for introduction into a turbine where that steam is converted into useful work. In such a system, hot oil is typically used as the tube-side fluid and water (in either liquid or vapor form) is typically used as the shell-side fluid. A steam generator is a heat exchanger that serves to transfer the thermal energy of hot oil to liquid water to convert the liquid water to steam. The tube bundle is submerged in the liquid water (or other shell-side fluid) during the transfer of heat into the shell-side liquid. As the water (or other shell-side fluid) is converted into steam, it is replenished by introducing additional pre-heated feedwater into the shell-side chamber.

When the cavity of the shell is full of the liquid water and the tubes are filled with the hot oil, the liquid water surrounding the tubes of the tube bundle reaches its boiling point, thereby creating steam bundles. The process of the liquid water being converted into steam bundles is known as nucleate boiling. In existing steam generators, a deficiency known as vapor blanketing is prevalent. Vapor blanketing occurs due to the high surface tension of steam, which causes the liquid water to be unable to make surface contact with the outer surface of the tubes of the tube bundle. In other words, due to its high surface tension, the steam hugs the outside surfaces of the tubes and forms a vapor blanket, or a barrier of air, around the outer surface of the tubes that is impenetrable by the shell-side liquid water. Since the shell-side liquid water is unable to make contact with the tubes at areas having vapor blanketing, the temperature of the tubes exceeds the thermal capacity of the shell-side liquid water, thereby creating a hot spot.

Vapor blanketing typically occurs deep inside the tube bundle because the shell-side liquid water (or other shell-side fluid) is unable to reach the outer surfaces of the tubes that are located deep within the tube bundle fast enough to keep the outer surfaces of those tubes wet. Vapor blanketing inhibits heat transfer and results in a reduced heat exchanger performance.

Previous attempts to address the vapor blanketing problem have been ineffective and inefficient. For example, a common remedy to vapor blanketing is to use a more open tube layout with a larger pitch-to-diameter ratio of the tube bundle. This remedy requires the use of a much larger shell and therefore results in a much higher equipment cost. Thus, a need exists for an apparatus, method and/or system that eliminates the potential for vapor blanketing while not increasing the costs of manufacturing.

SUMMARY OF THE INVENTION

The present invention eliminates or minimizes the occurrence of vapor blanketing while permitting the use of a dense tube bundle that does not require a larger pitch-to-diameter ratio. The present invention increases the heat transfer rate, and hence, the vaporization rate compared to the currently available designs.

In one aspect, the invention can be a heat exchanger apparatus for converting a shell-side liquid to a vapor comprising: a shell having an inner surface forming a cavity, the shell comprising an inlet for introducing the shell-side liquid into the cavity and an outlet for allowing the vapor to exit the cavity; a tube bundle comprising a plurality of tubes for carrying a tube-side fluid located in the cavity and having a longitudinal axis; a shroud circumferentially surrounding the tube bundle and positioned between the tube bundle and the inner surface of the shell so that an annular space exists between the shroud and the inner surface of the shell; an opening in a bottom portion of the shroud that forms a passageway between the annular space and the tube bundle; and an opening in a top portion of the shroud that forms a passageway between the annular space and the tube bundle.

In another aspect, the invention can be a heat exchanger apparatus for converting a shell-side liquid to a vapor comprising: a shell having a cavity, the shell comprising an inlet for introducing the shell-side liquid into the cavity and an outlet for allowing the vapor to exit the cavity; a tube bundle positioned in the cavity and comprising a plurality of tubes for carrying a hot tube-side fluid; a thermal insulating barrier positioned between the tube bundle and the shell so that a space exists between the thermal insulating barrier and the shell, an opening in a bottom portion of the thermal insulating barrier that forms a passageway between the space and the tube bundle, an opening in a top portion of the thermal insulating barrier that forms a passageway between the space and the tube bundle; and wherein heat emanating from the tube bundle causes a natural cyclical thermosiphon flow of the shell-side liquid within the cavity.

In a further aspect, the invention can be a method of generating a vapor within a heat exchanger comprising a shell, a tube bundle positioned within the shell, and a thermal insulating barrier located between the tube bundle and the shell to form a space between the thermal insulating barrier and the shell, the method comprising: introducing a shell-side liquid into the space of the cavity of the shell, the shell-side liquid submerging the tube bundle and the thermal insulating barrier; and flowing a hot tube-side liquid through the tube bundle, thereby heating the shell-side liquid that is adjacent the tube bundle so that a first portion of the shell-side liquid is vaporized and a second portion of the shell-side liquid is heated and drawn into a natural cyclical thermosiphon flow about the thermal insulating barrier within the cavity.

DETAILED DESCRIPTION OF THE INVENTION

Figure 1:
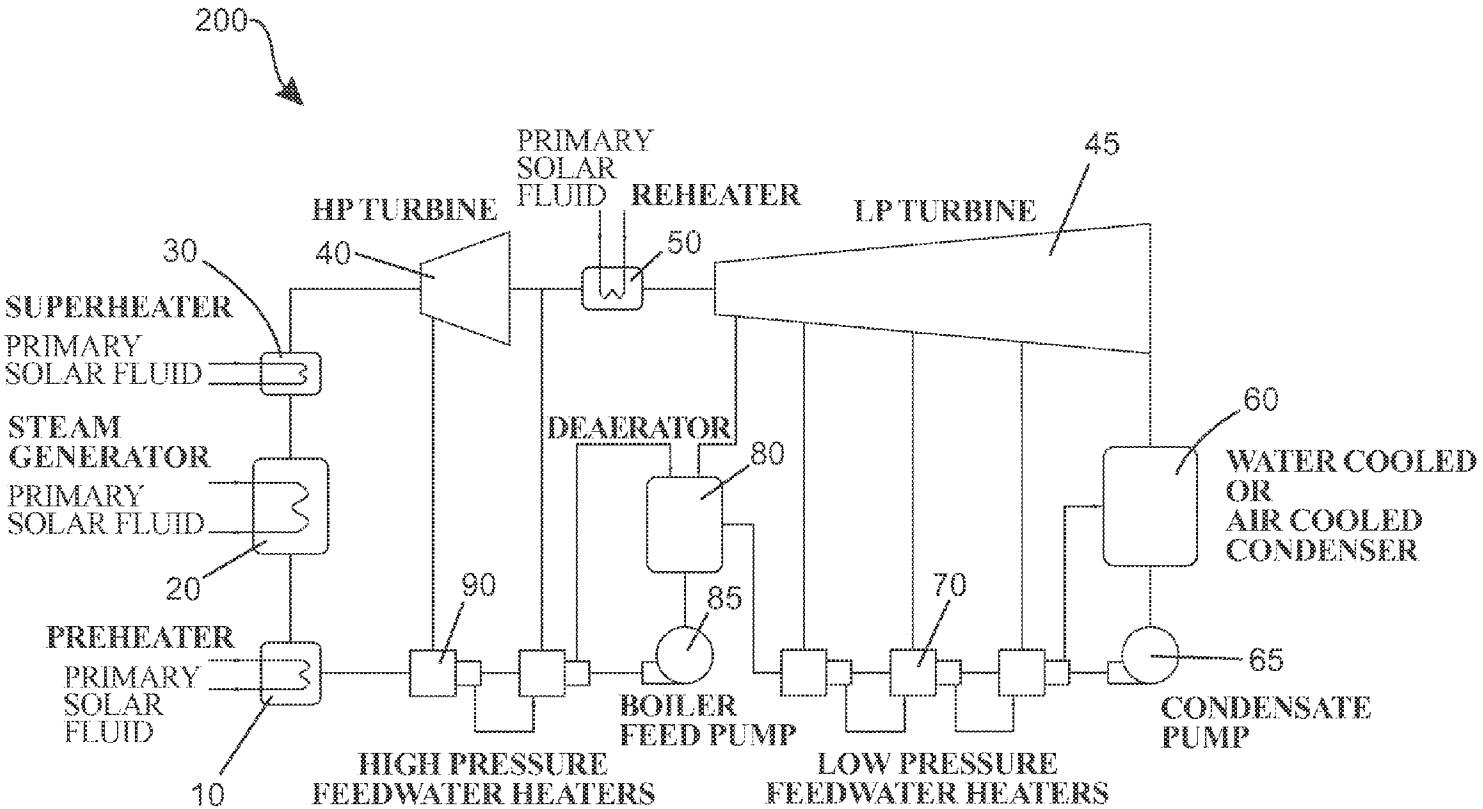
FIG. 1 is a schematic of a heat balance diagram for a solar power plant.

Referring to FIG. 1, a schematic of a solar power plant 200 is illustrated according to an embodiment of the present invention. While the invention is discussed in terms of (or incorporated into) a solar power plant 200, the invention is not so limited and can be used in any environment in which a heat exchanger is desired to convert liquid into a vapor.

The solar power plant 200 generally comprises a preheater 10, a steam generator 20, a superheater 30, a high pressure (HP) turbine 40, a reheater 50, a low pressure (LP) turbine 45, an air cooled condenser 60, a condensate pump 65, a low pressure feedwater heater 70, a deaerator 80, a boiler feed pump 85 and a high pressure feedwater heater 90. All of the aforementioned components of the solar power plant 200 are arranged and operably coupled to one another as is known in the art.

In the solar power plant 200, the preheater 10 is used to preheat a secondary fluid, which is water in the exemplified embodiment. Once preheated in the preheater 10, the preheated water flows into the steam generator 20 where it is converted (i.e., boiled) into vapor (i.e., steam). However, it is possible to omit the pre-heater 10 if desired. Although the solar power plant 200 will be discussed as using water as the secondary fluid, the invention is not so limited and other fluids may be used in place of water. Furthermore, as used herein, the term fluid is intended to include liquid, gas, vapor, plasma or any combination thereof that may be used in a heat exchanger device.

The preheater 10 is a high pressure container or shell that preheats the water so that the water does not need to be heated in one step from an ambient temperature to a final temperature within the steam generator 20. Using the preheater 10 is preferred because it increases efficiency and minimizes thermal shock stress to components, as compared to injecting ambient temperature liquid into a steam generator or other device that operates at extreme temperatures.

The preheated water, often referred to as the feedwater, is introduced into the steam generator 20 where the preheated water is converted to steam. As water in the steam generator 20 continually turns to steam and vacates the steam generator 20, additional preheated water from the preheater 10 is continuously introduced into the steam generator 20 to replenish the recently vacated water. The steam generator 20 uses heat from the tube-side fluid, which is preferably a hot oil or other primary fluid that is heated through the use of solar panels, to convert the preheated water to steam through a thermal energy transfer process. Of course, the primary fluid may be the shell-side fluid and the preheated water may be the tube-side fluid if desired.

The tube bundle of the steam generator 20 is preferably a two pass U-tube design. The invention, however, is not so limited. For example, the steam generator 20 may be a single pass heat exchanger or a U-tube heat exchanger with four, six, eight or more passes. The steam generator 20 in the solar power plant 200 serves to produce high pressure steam in a classical kettle type heat exchanger by circulating hot oil through the tubes of the tube bundle. The hot oil is the primary fluid (i.e., the tube-side fluid) and it is typified by a high boiling point and an even higher flashpoint so that the energy captured by the solar collectors can be transferred to it, raising its temperature to between 700° F. and 800° F. without any risk. The hot oil primary fluid causes the water or other secondary fluid (i.e., shell-side fluid) to heat up, evaporate and convert to pressurized vapor or steam.

The steam produced within the cavity of the shell that exits the steam generator 20 is introduced into the superheater 30 where the saturated or wet steam is converted into a dry steam that can be used for power generation. The superheater 30 is also preferably a two pass U-tube heat exchanger but can be any of the types mentioned above in a preferred embodiment, the solar heated primary fluid flows through the tube-side and the wet steam flows through the shell-side of the superheater 30. Of course, the invention is not so limited.

Upon exiting the superheater 30, the superheated dry steam enters the HP steam turbine 40 where the thermal energy from the pressurized steam is converted into rotary motion. Next, the partially spent steam that emerges from the HP turbine 40 is reheated by the primary fluid in the reheater 50, which is another heat exchanger apparatus. The steam emerging from the HP turbine 40 has a small fraction of moisture content. Utilizing the heat from the primary fluid, the wet steam is superheated in the reheater 50 prior to being introduced into the LP turbine 45 in order to remove as much of the moisture as possible. Reheating the steam in the reheater 50 enhances the thermal efficiency of the power plant.

Once reheated, the steam is introduced into the LP turbine 45. The HP and LP turbines 40, 45 are coupled with electric generators in order to produce electricity. Specifically, the pressurized steam that is fed through the HP and LP turbines 40, 45 is used to drive an electrical generator which is connected to the electric grid for distribution. The spent steam emerging from the LP turbine 45 is transported to the water or air cooled condenser 60 where it is converted into condensate. The condenser 60 converts the steam back to a liquid so that it can be pumped back to the steam generator 20. However, prior to re-entering the steam generator 20, a few more steps must be completed.

Specifically, the condensate is pumped from the condenser 60 by a condensate pump 65 to one or more low pressure feedwater heaters 70 for preheating. The heated condensate is then deaerated in a deaerator 80 and pumped into the high pressure feedwater heater 90 using boiler feed pumps 85. The preheated and pressurized condensate is then pumped back into the preheater 10 where the process starts over.

Figure 2:
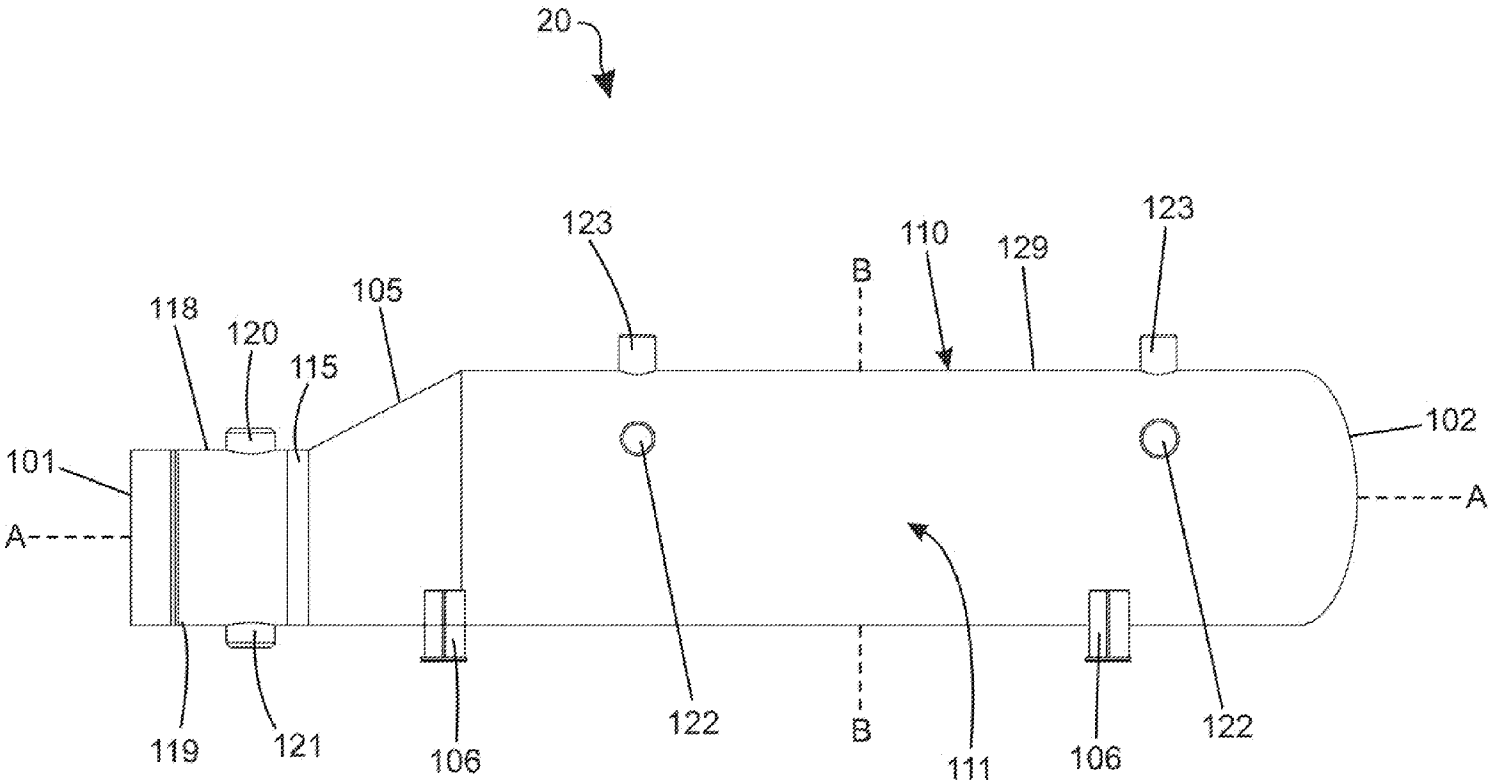
FIG. 2 is side view of a heat exchanger according to an embodiment of the present invention.
Figure 3:
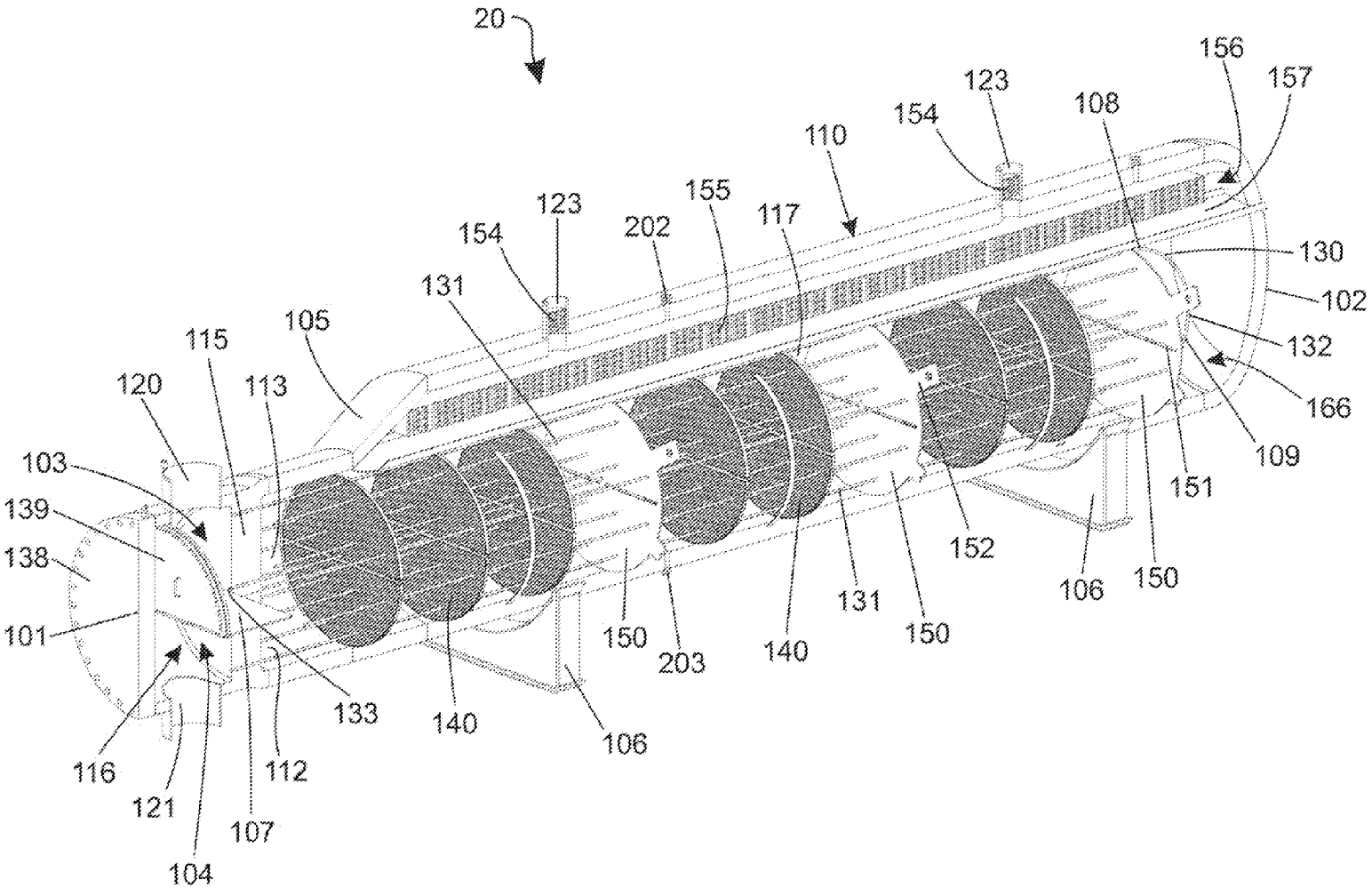
FIG. 3 is a perspective view of the heat exchanger of FIG. 2 with a longitudinal cross-section of the shell cutaway and a section of the insulating shroud removed so that the details of the tube bundle are visible.

Referring now to FIGS. 2 and 3 concurrently, an embodiment of the steam generator 20 (referred hereafter as a heat exchanger) according to the present invention will be described. The heat exchanger 20 is specially designed to eliminate and/or reduce vapor blanketing and the other problems discussed above by facilitating a natural cyclical thermosiphon flow of the shell-side liquid (i.e., the water) within the cavity of the shell 110. The heat exchanger 20 reduces costs and enhances heat transfer rates.

The heat exchanger 20 is preferably a kettle-type steam generator. In the exemplified embodiment, the heat exchanger 20 is an elongated tubular type heat exchanger that extends along a longitudinal axis A-A from a proximal end 101 to a distal end 102. The heat exchanger 20 comprises a plurality of vents 202 and a plurality of drains 203 for emptying a shell-side liquid from the shell 110 and/or for maintaining a desired shell-side liquid level within the shell 110. Preferably all components of the heat exchanger 20, including the shell 110, the tube bundle 130 and all other major components, are constructed of a metal, such as steel, aluminum, iron, etc. Of course, other materials can be used as desired so long as the proper thermal transfer can be effectuated between the shell-side fluid and the tube-side fluid. It is preferable that the materials used for the various components are capable of withstanding corrosion or damage when submerged in or otherwise subjected to temperatures in excess of 800° F.

The heat exchanger 20 generally comprises a shell 110 having an internal cavity 113 and a tube bundle 130 positioned therein. The heat exchanger 20 also comprises a tube sheet 115 disposed in the cavity 113 in a substantially transverse orientation that separates the internal cavity 113 into a tube-side chamber 116 and a shell-side chamber 117. The tube-side chamber 116 extends longitudinally from the tube sheet 115 to the proximal end 101 of the shell 110 while the shell-side chamber 117 extends longitudinally from the tube sheet 115 to the distal end 102 of the shell 110.

The heat exchanger 20 comprises a plurality of inlets and outlets 120-123 that form passageways through the shell 110 so that fluids can pass into or out of different constituent components and/or internal chambers of the shell 110. Specifically, the heat exchanger 20 comprises a tube-side fluid inlet 120, a tube-side fluid outlet 121, shell-side fluid inlets 122 and shell-side fluid outlets 123. In a preferred embodiment, the tube-side fluid inlet 120 is located on a top portion 118 of the shell 110 while the tube-side fluid outlet 121 is located on a bottom portion 119 of the shell 110. As will be described below with reference to FIG. 5, positioning the tube-side fluid inlet 120 on the top portion 118 of the shell 110 and the tube-side fluid outlet 121 on the bottom portion 119 of the shell 110 assists in facilitating an efficient natural cyclical thermosiphon flow of the shell-side fluid within the shell-side chamber 117.

The shell-side fluid inlets 122 form passageways into the shell-side chamber 117 from outside of the shell 110 so that a shell-side fluid can be introduced into the shell 110 for vaporization. The shell-side fluid may be a fluid that is preheated within the pre-heater 10 or it may be a fluid that is introduced into the heat exchanger 20 at ambient temperature. The shell-side fluid is preferably water because steam is an efficient vapor for use in power generation. Of course, the invention is not so limited and other fluids may be used as desired. As discussed above with respect to FIG. 1, the shell-side fluid inlet 122 may be coupled to the outlet of the pre-heater 10 so that preheated water exiting the pre-heater is introduced into the heat exchanger 20. As discussed below with reference to FIGS. 3-5, the position of the shell-side fluid inlets 122 on the shell-side chamber 117 is selected to facilitate and/or enhance a natural cyclical thermosiphon flow of the shell-side fluid within the shell-side chamber 117 during operation.

The shell-side fluid outlets 123 are located on a top portion 129 of the shell 110. Positioning the shell-side fluid outlets 123 on the top portion 129 of the shell 110 allows the vaporized shell-side fluid to freely and naturally escape the shell-side chamber 117 and, thus, the heat exchanger 20. In other words, as the shell-side fluid is boiled and converted to its vapor state within the shell-side chamber 117, it rises within the shell-side chamber 117 and flows out of the outlets 123.

In a preferred embodiment, the tube-side fluid is hot oil and the shell-side fluid is preheated water. The invention, however, is not so limited and the shell-side fluid may be hot oil and the tube-side fluid may be preheated water. Of course, any other fluids can be used as desired.

The tube-side chamber 116 of the heat exchanger 20 has a constant circular transverse cross-sectional area. Of course, the tube-side chamber 116 may have a cross-sectional area of any shape and does not need to be constant. The cross-sectional area of the shell-side chamber 117 is no constant for its entire longitudinal length and gradually increases at a transition section 105 moving from the tube sheet 115 toward the distal end 102. The shell-side chamber 117 has a constant cross-sectional area and shape from the tube sheet 115 to the transition section 105. After the transition section 105, the shell-side chamber 117 once again has a constant cross-sectional area (that is increased in size) until the end 102 of the shell 110. The invention, of course, is not limited to any specific geometric arrangement and/or size of the shell-side chamber 117 (or any other chamber) unless specifically recited in the claims.

Conceptually, the shell-side chamber 117 of the cavity 113 comprises an upper portion 156 and a lower portion 166 that extend in a longitudinally adjacent manner. The upper portion 156 is defined along the longitudinal length of the shell-side chamber 117 in that portion of the shell-side chamber 117 after the transition section 105 that has the increased cross-sectional area. The upper portion 156 of the shell-side chamber 117 contains those components of the heat exchanger 20 that are not intended to be submerged in the liquid form of the shell-side fluid during operation, such as the drip tray 1.57 and the moisture separators 155, 154. Though of another way, the liquid level of the shell-side liquid is preferably maintained below the upper portion 156 during operation. To the contrary, the lower portion 166 of the shell-side chamber 117 of the cavity 113 is intended to be filled with the liquid state of the shell-side liquid and, thus, contains those components of the heat exchanger 20 that are meant to be submerged in the liquid state of the shell-side fluid, such as the stabilizing plates 140, the partition plates 150, and the tube bundle 130.

The heat exchanger 20 further comprises a pair of fixed supports 106 for maintaining the heat exchanger 20 in a horizontal orientation. However, the invention is not limited to horizontal heat exchangers and vertical heat exchangers are also contemplated and within the scope of the present invention.

Referring now solely to FIG. 3, the internal components of the heat exchanger 20 will be described in greater detail. The internal cavity 113 of the shell 110 is formed by an inner surface 112 of the shell 110. The tube bundle 130 comprises a plurality of double pass U-tubes 131 arranged in a dense packing (only a few of the U-tubes 131 are illustrated for clarity and to avoid clutter). The tube bundle 130 is positioned within the shell-side chamber 117 of cavity 113 and is generally coextensive with the longitudinal axis A-A. Of course, other shaped tubes, including straight tubes, may be used in the tube bundle 130. However, as will be described below with reference to FIG. 5, U-tubes 131 are preferred in order to achieve a natural cyclical thermosiphon flow of the liquid state shell-side fluid within the shell-side chamber 117 that is effective in eliminating and/or reducing vapor blanketing on the U-tubes 131 of the tube bundle 130 during operation. Finally, while the U-tubes 131 are exemplified as being double pass U-tubes, the invention is not so limited and each of the U-tubes 131 may include four, six, eight or more passes.

The U-tubes 131 have a general U-shape having a bight portion 132 that is generally located adjacent the distal end 102 of the shell 110 and two straight legs 108, 109 that are operably coupled to (or extend through) openings 133 in the tube sheet 115. The legs 108, 109 extend through the openings 133 in the tube sheet 115 so as to form passageways into the tube-side chamber 116. The tube-side chamber 116 is separated into a top chamber 103 and a bottom chamber 104 by a partition plate 107. The partition plate 107 is a transverse wall that extends along the longitudinal axis A-A from the tube sheet 115 to the proximal end 101 of the shell 110 and creates two distinct, hermetically isolated chambers 103, 104. The partition plate 107 separates the tube-side chamber 116 so that the tube-side fluid can be introduced into the top chamber 103 via the tube-side fluid inlet 120 and flow into the top legs 108 of the U-tubes 131. The tube-side fluid will continue to flow through the bight portions 132 of the U-tubes 131 and into the bottom legs 109, where it will exit the U-tubes 131 into the bottom chamber 104. Once in the bottom chamber 104, the tube side fluid will be forced out of the shell 110 via the tube-side fluid outlet 121. By having the tube-side fluid enter the top legs 108 first, the top legs 108 are considered the "hot legs" because the tube-side fluid is hotter therein than in the bottom legs 109 because heat of the tube-side fluid is dissipated prior to reaching the bottom legs 109. Thus, the bottom legs 109 are considered the "cold legs." As discussed below, designing the heat exchanger 20 so that the hot legs 108 are above the cold legs 109 assists in facilitating an effective natural cyclical thermosiphon flow, as will be described in detail below with reference to FIG. 5.

While not necessary, the proximal end 101 of the shell 110 also comprises an access door 139 for accessing the internal cavity 113 of the shell 11.0 so that the tube bundle 130 and other components can be removed, cleaned and/or worked on for maintenance and up-keep. Removably attached to the access door 139 is an end cap 138 that creates a solid, hermetically sealed proximal end 101 of the heat exchanger 20.

Figure 6:
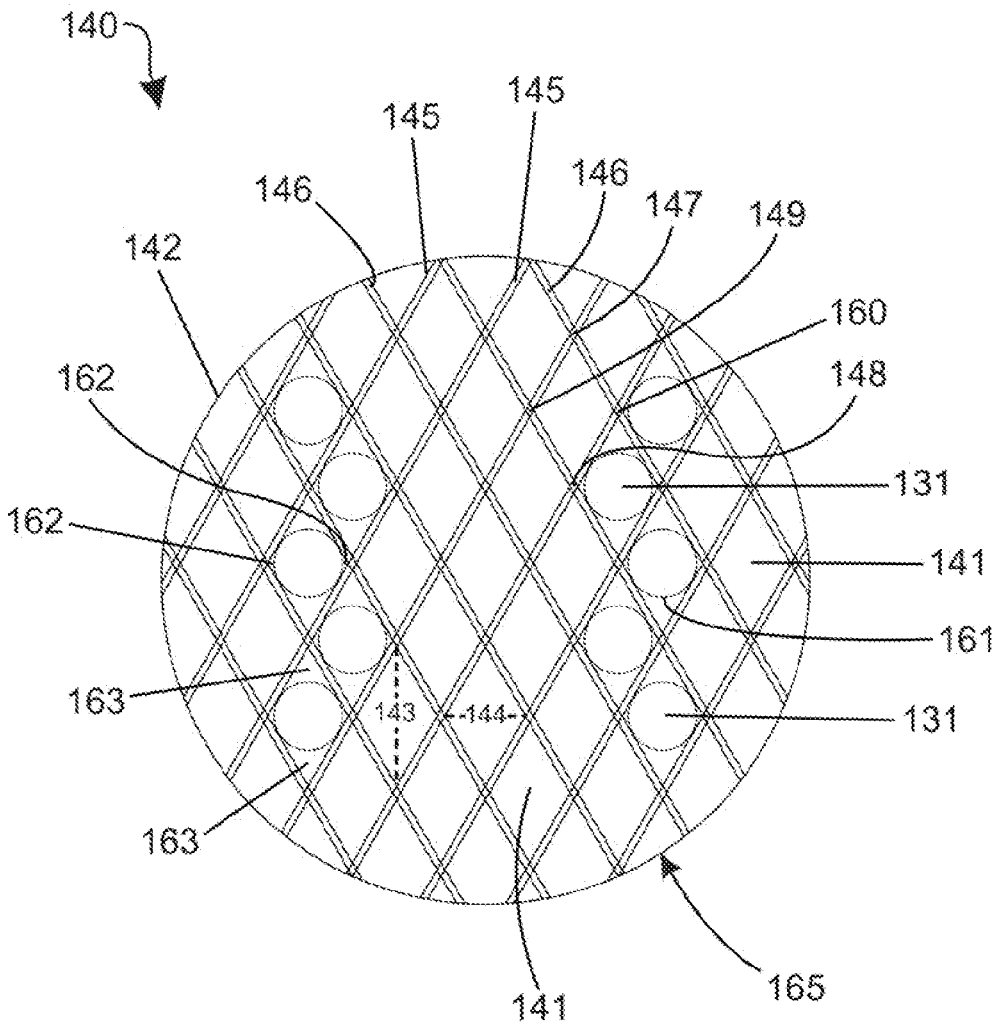
FIG. 6 is a front view of a portion of a stabilizing plate of the heat exchanger of FIG. 2 according to one embodiment of the present invention.
Figure 7:
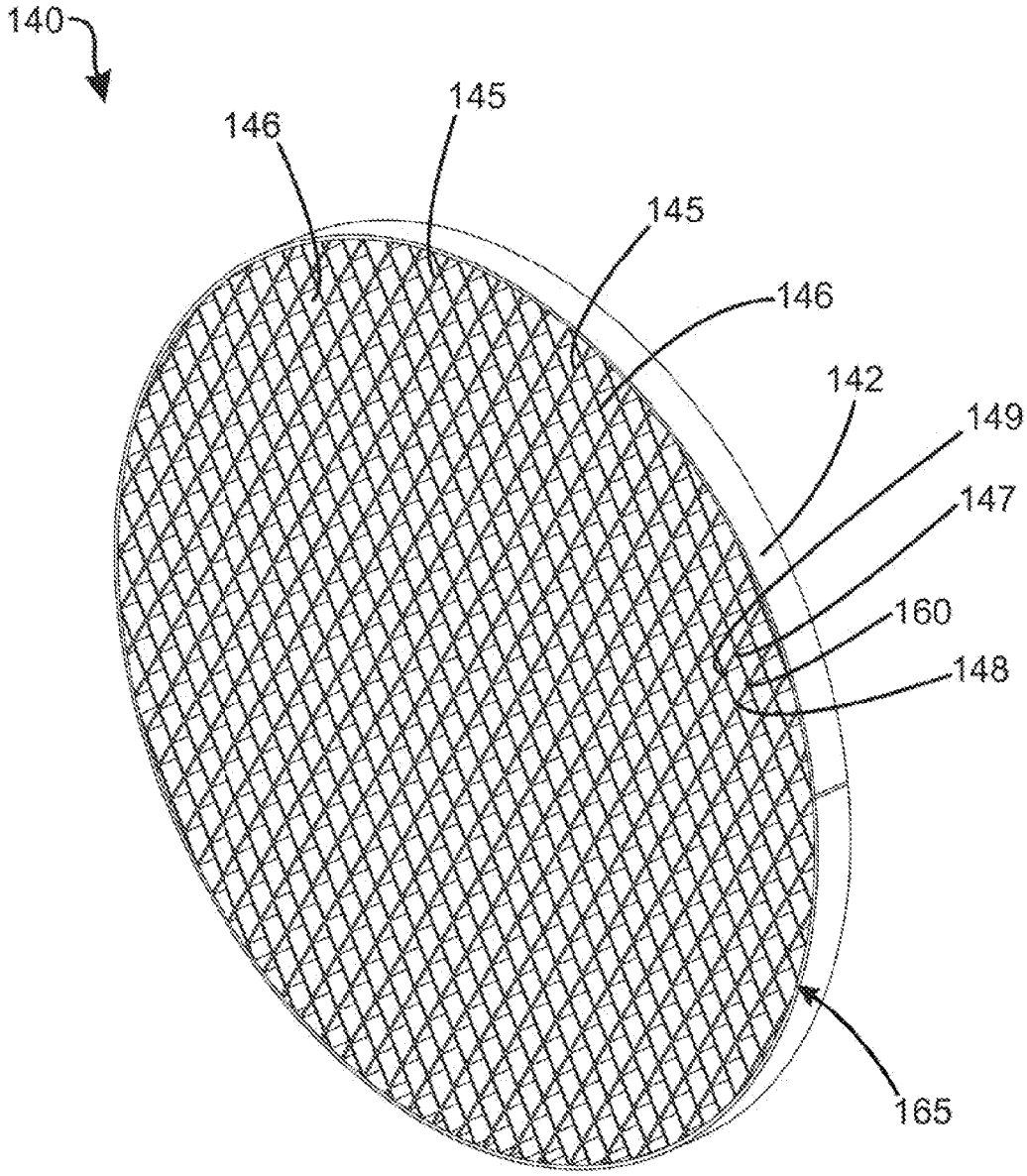
FIG. 7 is a perspective view of the stabilizing plate of the heat exchanger of FIG. 2 removed from the heat exchanger according to one embodiment of the present invention.
Figure 8:
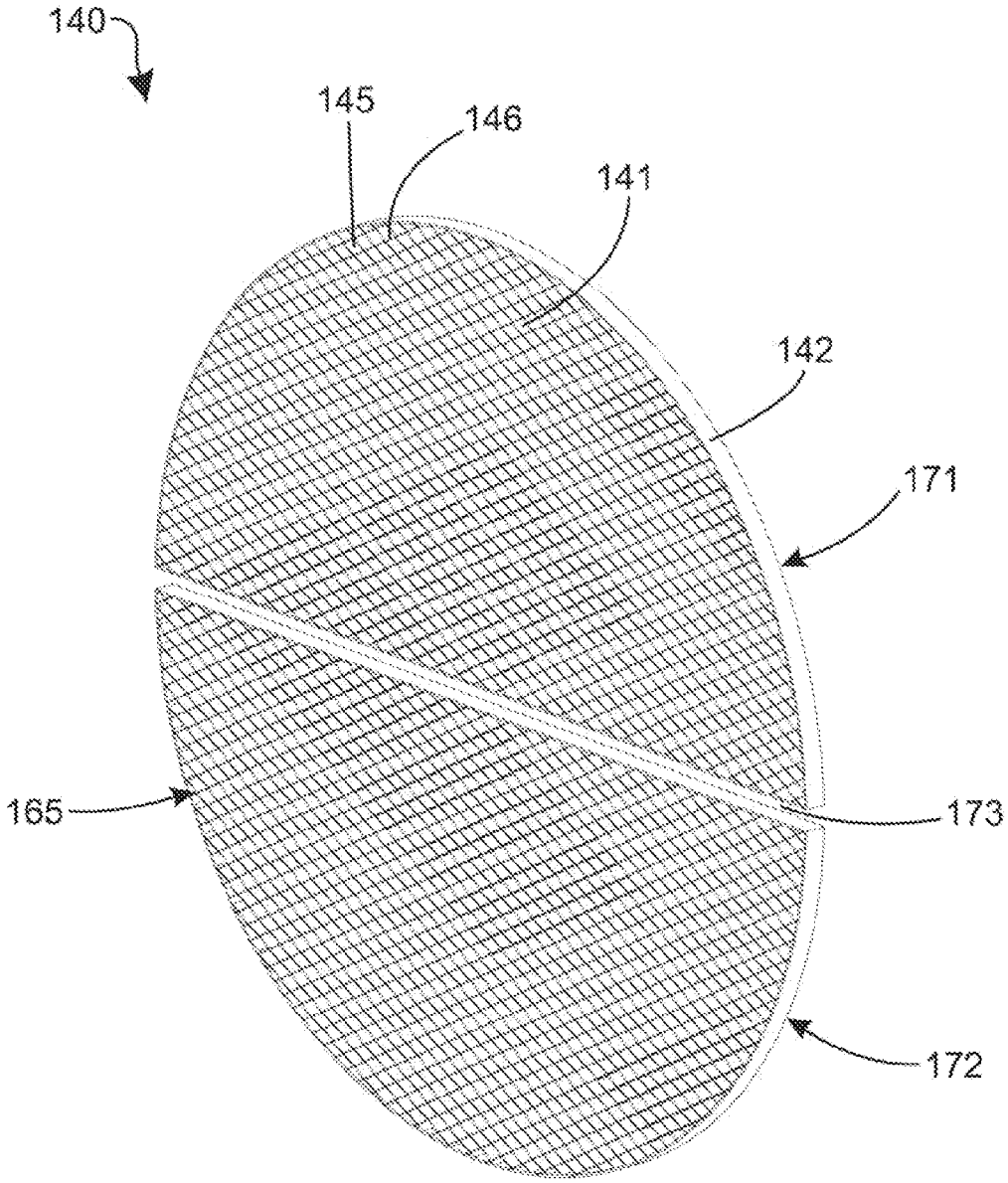
FIG. 8 is a perspective view of a stabilizing plate according to a second embodiment of the present invention.

The heat exchanger 20 also comprises a plurality of stabilizing plates 140 for supporting the U-tubes 131. The stabilizing plates 140 are positioned within the shell-side chamber 117 and arranged in a substantially transverse orientation. The stabilizing plates 140 comprise a lattice structure 165 having openings 141 that receive the legs 108, 109 of the U-tubes 131, thereby stabilizing the U-tubes 131 of the tube bundle 130 and permitting axial flow of the shell-side fluid along the U-tubes 131. The stabilizing plates 140 are preferably disk-shaped structures wherein the lattice structures 165 are formed by intersecting members in the form of thin, flat linear strips. These strips form a grid having rhombus shaped openings 141 (FIGS. 6-8). However, the invention is not so limited and the stabilizing plates 140 can take on any known shape and/or structural arrangement. Of course, the plate structures 140 may be omitted all together if desired.

The outer peripheral frames 142 of the stabilizing plates 140 preferably conform to the shape of the inner surface 112 of the shell 110. The peripheral frames 142 also enclose the lattice structure 165. The peripheral frames 142 of the stabilizing plates 140 are preferably welded, bolted, or otherwise attached to a structure within the heat exchanger 10 to provide stability and rigidity to the tube bundle 130. The specific details of the rhombus shaped openings 141, as well as the specific manner by which the U-tubes 131 are secured within the rhombus shaped openings 141 of the lattice structure 165, will be described below in greater detail with reference to FIGS. 6-8.

Referring still to FIG. 3, the heat exchanger 20 also comprises a plurality of transversely oriented partition plates 150 positioned within and axially interspersed throughout the longitudinal length of the shell-side chamber 117, thereby dividing the shell-side chamber into axial/longitudinal sections. The partition plates 150 are positioned between the stabilizing plates 140 throughout the axial length of the shell-side chamber 117 of the cavity 113. In the illustrated embodiment, there are seven stabilizing plates 140 and three partition plates 150 positioned within the cavity 113. However, the invention is not so limited and any number of partition plates 150 and/or stabilizing plates 140 may be positioned in the cavity 113. The exact number of each will depend on the size and length of the shell-side chamber 117, the structure of the tube bundle 130, and the operating condition of the heat exchanger 20.

The partition plates 150 comprise openings for supporting the U-tubes 131 therein. The openings of the partition plates 150 are sized to tightly retain the U-tubes 131 to prevent sagging of the U-tubes 131 and to prevent the U-tubes 131 from suffering damage due to vibration. The partition plates 150 also comprise two elongated slits 151 for enabling the shell-side fluid to flow axially therethrough. The partition plates 150 also comprise four flanges 152 extending transversely from an outer edge of the partition plates 150. The flanges 152 extend radially outwardly from the partition plates 150 toward the shell 110. The flanges 152 are used to retain and hold in place an insulating shroud 180, as well as secure the entire tube bundle assembly within the shell-side cavity 117, as will be discussed below in greater detail with reference to FIG. 4. The flanges 152 may extend to the inner surface 112 of the shell 110 so that they can be secured to the shell 110 by welding, bolting, etc. directly to the inner surface 112 of the shell 110 or to corresponding flanges extending therefrom.

It should be noted that relative terms such as axially, longitudinally, cross-flow, back-and-forth, left, right, up and down are merely used to delineate relative positions of the internal components of the heat exchanger 20 with respect to one another and with respect to the longitudinal axis A-A and are not intended to be in any further way limiting of the present invention.

The heat exchanger 20 further comprises a first moisture mesh 155 located in the upper portion 156 of the shell-side chamber 117 of the cavity 113. As noted above, the upper portion 156 of the shell-side chamber 117 is the portion of the shell-side chamber 117 that makes up the increased cross-sectional area of the shell-side chamber 117 in comparison to the tube-side chamber 116. The first moisture mesh 155 is positioned within the upper portion 156 of the shell-side chamber 117 of the cavity 113 so that it remains generally free of direct contact with the bulk liquid state shell-side fluid because it will not operate effectively if it becomes submerged in the liquid.

The first moisture mesh 155 is a piece of material that separates any liquid-phase moisture that remains in the vapor before the vapor exits the heat exchanger 20. As the shell-side liquid is boiled and converted to vapor, it flows upwardly towards the shell-side fluid outlet 123, as discussed above. However, as it flows upwardly, the vapor will still contain some minute droplets of liquid and, thus, is not a completely dry vapor. The first moisture mesh 155 serves to remove/filter the liquid droplets from the vapor so that the vapor exiting the heat exchanger 20 is as dry as possible.

A second moisture mesh 154 is located within the shell-side fluid outlet 123. The second moisture mesh 154 captures and separates any finer liquid droplets that may have passed through the first moisture mesh 155 with the vapor. Preferably, the second moisture mesh 154 has a smaller pore size than the first moisture mesh 155, and thus can capture smaller sized droplets. The first and second moisture mesh can be a wire mesh or of other constructs know in the art.

Alternatively, rather than using a mesh-type construct as the moisture separator, it may be in some embodiments to incorporate a centrifugal-type moisture separator. Centrifugal moisture separators induce a circular flow, helical flow, or other type of flow of the exiting steam (which includes the entrained water droplets) that will subject the steam to centrifugal force. When subjected to centrifugal force, the large difference in density between the entrained water droplets (liquid phase) and the steam (vapor) causes the water droplets to separate from the vapor.

Figures 5, 5A:
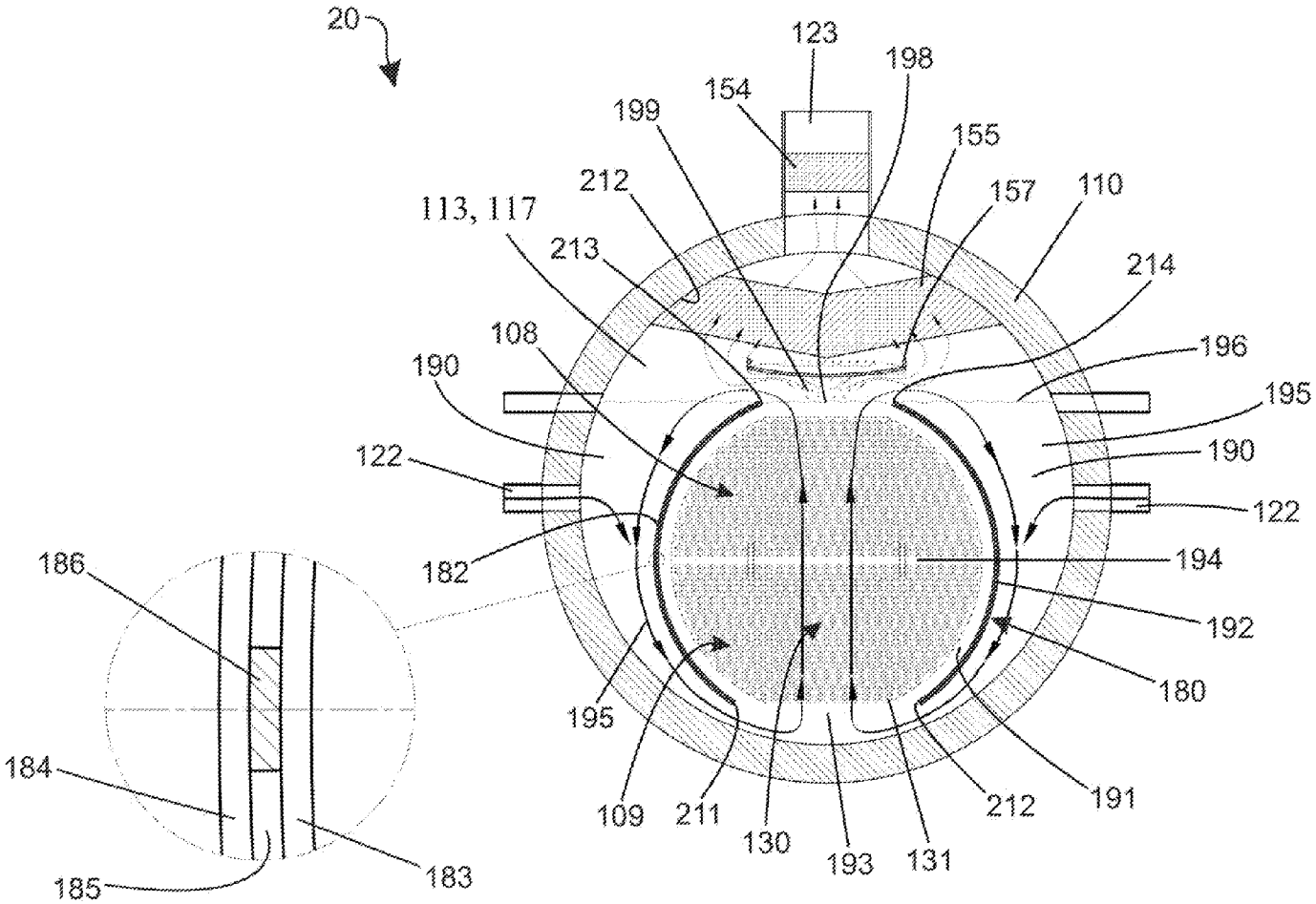
FIG. 5 is a lateral cross-sectional schematic of the heat exchanger of FIG. 2.
FIG. 5*a* is a close-up cross-sectional view of the insulating shroud in accordance with an embodiment of the present invention.

The heat exchanger 20 further includes a drip tray 157 located within the upper portion 156 of the shell-side chamber 117 below the moisture separators 154, 155 and above the tube bundle 130. The drip tray 157 is essentially a trough that is capable of catching liquid moisture that is filtered by the moisture separators 154, 155 (or otherwise condenses before exiting the heat exchange 20). The drip tray 157 is sloped and/or oriented to redirect the flow of the captured liquid to a desired area within the shell-side chamber 117 that will not detract from the thermosiphon flow. Alternatively, the drip tray 157 may redirect the captured liquid to a position outside of the shell 110. Any liquid that is captured by the first and second moisture meshes 154, 155 will be caught by the drip tray 157 in order to keep the reclaimed liquid from merely dripping into the shell-side liquid immediately below it. This is desirable because at the point directly below the second moisture mesh 154, the shell-side liquid has been converted into a bath of steam flow 199 (FIG. 5). If the moisture caught by the moisture mesh 154, 155 were to intermix with the bath of steam flow 199, it would negatively affect the efficiency of the heat exchanger 20. Therefore, the drip tray 157 captures the reclaimed liquid and either carries it to a port for exiting the heat exchanger 20 or introduces it back into the shell-side chamber 117 at some position away from the bath of steam flow 199 (such as in the annular gap 190 or at a point after the tube bundle 130).

Figure 4:
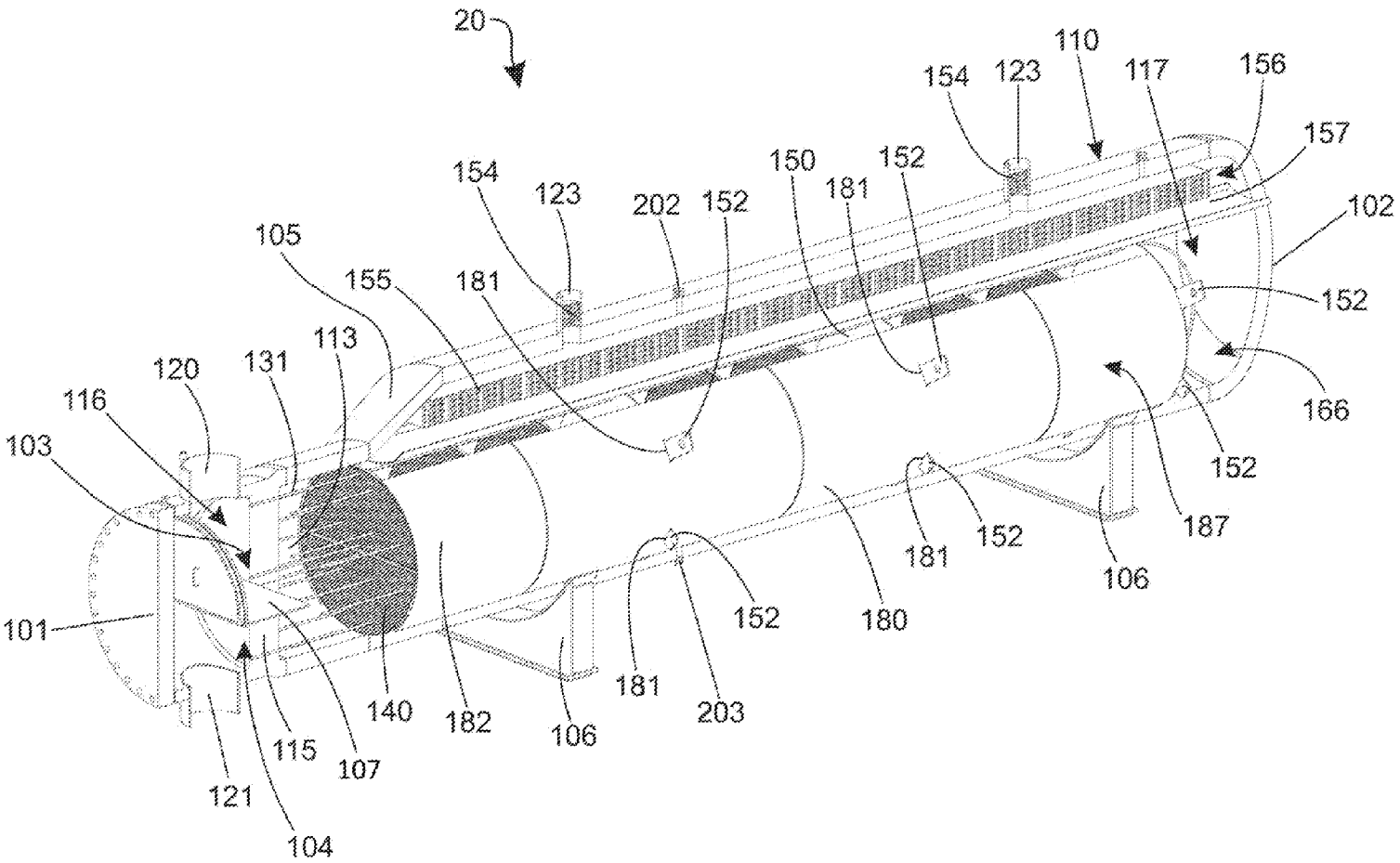
FIG. 4 is perspective view of the heat exchanger of FIG. 2 with a longitudinal cross-section of the shell cutaway and the insulating shroud in place.

Referring now to FIGS. 4-5 concurrently, the heat exchanger 20 further comprises an insulating shroud 180 that is positioned within the shell-side chamber 117 between the shell 110 and the tube bundle 130, thereby forming an annular space 190 between the insulating shroud 180 and the shell 110. The shroud 180 is a thermal insulating barrier that is positioned between the tube bundle 130 and the inner surface 112 of the shell 110. More specifically, the shroud 180 comprises a first arcuate section 182 and second arcuate section 192 that collectively form a generally cylindrical structure that circumferentially surrounds the tube bundle 130. The shroud 180 further comprises a top opening 198 above the tube bundle 130 and a bottom opening 193 below the tube bundle 130. While the shroud 180 is formed by the two separate and distinct arcuate (or par-cylindrical) sections 182, 192, the invention is not so limited and the shroud could be a singular structure with the top and bottom holes 198, 193 formed appropriately therein.

In the exemplified embodiment, the arcuate sections 182, 192 are positioned on opposite lateral sides of the tube bundle 130. In such a structural embodiment, the bottom opening 193 is formed between a bottom edge 211 of the first arcuate section 182 and a bottom edge 212 of the second arcuate section 192. Similarly, the top opening 198 is formed between a top edge 213 of the first arcuate section 182 and a top edge 214 of the second arcuate section 192. In the illustration shown in FIG. 4, only one of the arcuate sections 182, 192 of the shroud 180 is visible.

The insulating shroud 180 comprises one or more slots 181 that are sized and configured so that the flanges 152 of the partition plates 150 can extend therethrough. As a result, the flanges 152 of the partition plates 150 support the insulating shroud 180 and retain it in its desired position within the shell-side chamber 117. The flanges 152 extend through the slots 181, thereby extending from an outer surface 187 of the shroud 180 so that the flanges 152 can be secured to the shell 110 as described above. However, the invention is not limited, and the shroud 180 can be supported in any other manner. For example, the shroud 180 may extend the entire longitudinal length of the shell-side chamber 117 so that it can be welded, bolted or otherwise secured directly to the shell 110 and/or the tube sheet 115.

Each of the arcuate sections 182, 192 of the shroud 180 may be formed as a single unitary structure or as several longitudinal sections that are welded or otherwise fastened together. Regardless of whether the arcuate sections 182, 192 of the shroud 180 are formed of a unitary piece or attached sections, each arcuate section 182, 192 of the shroud 180 is substantially impermeable to the flow of the shell-side liquid, thereby forcing the shell-side liquid to flow around the shroud 180 during operation of the heat exchanger 20. As discussed below with respect to FIG. 5 alone, it is the existence of the insulating shroud 180 that is primarily responsible for the natural cyclical thermosiphion flow of the shell-side liquid.

Moreover, the shape of the shroud 180 (or its sections 182, 192) is not limiting of the present invention. For example, the sections 182, 192 may be mere flat plates or a combination of planar sections. Finally, as used herein, the term "arcuate" includes shapes formed by a plurality of linear segments that overall resemble an arc.

Referring solely now to FIG. 5, a transverse cross-sectional schematic of the heat exchanger 20 is illustrated. In the exemplified embodiment, both of the arcuate sections 182, 192 that make up the shroud 180 are clearly visible. Each arcuate section 182, 192 of the shroud 180 is positioned in the shell-side chamber 117 between the inner surface 112 of the shell 110 and the outer surface of the tube bundle 130 so that the annular space 190 is formed between the shell 110 and the shroud 180. It is also preferable that an annular gap/space 191 exists between the tube bundle 130 and the shroud 180.

During operation, the hot tube-side fluid is introduced into the tube-side chamber 116 via the tube-side fluid inlet 120. The tube-side fluid is preferably hot oil having a temperature in the range of 700-800° F. However, the invention is not so limited and the tube-side fluid may have hotter or cooler temperatures depending on the particular use to which the heat exchanger will be put. This hot tube-side fluid then flows through the U-tubes 131 of the tube bundle 130, entering the hot legs 108 and exiting the cool legs 109. As can be seen, the hot legs 106 are positioned above the cool legs 109. As the tube-side fluid flows through the U-tube bundle 130, it cools down slightly due to heat being transferred to the shell-side liquid. Therefore, as the tube-side fluid passes the bight portions 132 and enters the cool/bottom legs 109 of the U-tube bundles 130, the tube-side fluid is cooler than it is in the hot/top legs 108. The tube-side fluid is still extremely hot as it enters and flows through the bottom legs 109 of the U-tube bundle 130. However, the term cool is used in order to describe the temperature of the tube-side fluid in the bottom leg 109 of the U-tube bundle 130 relative to the temperature of the tube-side fluid in the top leg 108 of the U-tube bundle 130. Thus, the top leg 108 of the U-tube bundle 130 is referred to as the hot leg of the U-tube bundle 130 and the bottom leg 109 of the U-tube bundle 130 is referred to as the cool leg of the U-tube bundle 130. Orienting the U-tubes 131 so that the hot legs 108 are above the cool legs 109 helps facilitate a strong natural cyclical thermosiphon flow within the shell-side chamber 117 by accelerating the upward flow of the shell-side liquid within the region of the tube bundle 130.

During operation, the shell-side liquid is also introduced into the cavity 113 at an elevated temperature but under high pressure so as to prevent vaporization. However, as the shell-side liquid is further heated by the tube bundle 130 within the shell-side chamber 117 of the cavity 113, it is converted into vapor. As used herein, it is to be understood that any reference to the temperature of the shell-side fluid being cool is in comparison to a higher temperature of the shell-side fluid (for example at the temperature that it becomes converted into vapor). Stated simply, the use of the terms "hot" and "cool" with reference to both the shell-side fluid and the tube-side fluid are intended to be relative only and are not intended to indicate an actual or specific temperature of the fluids.

As mentioned above, the shell-side liquid is introduced into the cavity 113 of the shell 110 at a relatively cool state through the shell-side fluid inlets 122. Specifically, the cool shell-side liquid is introduced into the annular space 190 formed between the shell 110 and the shroud 180. Thus, the cool shell-side liquid is introduced into the annular space 190 prior to any initial heating by the primary fluid flowing through the tube bundle 130. The shell-side liquid is provided and maintained at a level that submerges the tube bundle 130 and the shroud 180, as well as the stabilizing structures 140 and the partition plates 150.

Once the shell-side liquid fully submerges the tube bundle 130 and the shroud 180, the tube-side fluid begins to flow through the tube bundle 130. The tube-side fluid, by nature of its temperature being higher than the temperature of the shell-side liquid, heats the shell-side liquid that is adjacent the tube bundle 130 (i.e., in the space 194 between the two arcuate sections 182, 192 or within the shroud 180). As a result of this thermal transfer, a portion of the shell-side liquid is vaporized and a second portion of the shell-side liquid is further heated (but does not vaporize), thereby rising upward within the space 194 and through the tube bundle 130. As the rising warmed shell-side liquid absorbs additional heat from the tube bundle 130, its upward flow is further encouraged. As mentioned above, this upward flow is further facilitated and strengthened by the hot legs 108 being positioned above the cool legs 109 of the tube bundle 130. The flow of the shell-side liquid that is induced within the shell-side chamber 117 is indicated by cyclical arrows 195.

As the shell-side liquid (and the vapor) within the space 194 flows upward, it exits the space 194 via the top opening 198 in the shroud 180 and flows into the annular space 190. From here, the vaporized shell-side fluid flows around the drip tray 157, through the moisture separators 155, 154, and out of the shell-side chamber 117. However, as the portion of the shell-side liquid that was not converted into vapor during its first pass through the tube bundle 130 flows through the top opening 198, it begins to cool slightly by virtue of no longer being directly adjacent the tube bundle 130. The continued upward flow of more shell-side liquid coming out of the top opening forces the slightly cooled shell-side liquid outward toward the walls of the shell 110. Thereafter, this slightly cooled portion of the shell-side liquid flows downwardly through the annular space 190 where is siphoned back into the shroud 180 and into contact with the tube bundle 130 again via the bottom opening 193, thereby completing a natural thermosiphon flow cycle. The process repeats itself as the shell-side fluid in the space 194 adjacent the tube bundle 130 becomes heated through heat transfer from the fluid in the tube bundle 130 and flows upwardly.

Additional shell-side liquid is introduced into the thermosiphon flow/stream in the annular space 190 via the shell-side fluid inlet 122 in order to replace any shell-side liquid that has become vaporized. This newly added shell-side liquid is cooler than the shell-side fluid that is already within the cavity 113 and, thus, assists with the natural downward flow of the shell-side liquid through the annular space 190.

As mentioned briefly above, while this natural cyclical thermosiphon flow of the shell-side liquid is taking place, some of the shell-side liquid is becoming heated to its boiling point so as to create the bath of steam flow 199. The vaporized shell-side fluid escapes the shell-side liquid and rises above the liquid level 196 of the shell-side liquid within the cavity 113. The vapor then continues to flow up through the first moisture mesh 155. The first moisture mesh 155 traps moisture from the liquid vapor, which then falls into the drip tray 157. The vapor continues to rise up through the shell-side fluid outlet 123 and passes through the second moisture mesh 154.

It should be apparent that it is the existence of the shroud 180 that facilitates the aforementioned natural cyclical thermosiphon flow (arrows 195) by keeping the less dense vapor bearing shell-side liquid in the space 194 from the denser single-phase shell-side liquid within the annular space 190. This recirculation flow 195 has the effect of sweeping up the vapor bubbles within the space 194 and keeping the tube bundle 130 wet, thereby avoiding the negative effects of vapor blanketing. Furthermore, the recirculation flow 195 ensures an increased heat transfer rate.

In order to promote the thermosiphon flow, it is preferred that the shroud 180 thermally insulate the shell-side liquid located within the annular space 190 from the shell-side liquid located within the annular space 194. Stated simply, one does not want heat to transfer freely through the shroud 180. Thus, it is preferred that the shroud 180 be an insulating shroud in the sense that its coefficient of thermal conductivity (in the radial direction) is less than the coefficient of thermal conductivity of the shell-side liquid. Making the coefficient of thermal conductivity of the shroud 180 less than the coefficient of thermal conductivity of the shell-side liquid ensures that the shell-side liquid in the annular gap 190 remains cooler than the shell-side liquid located in the space 194, thereby maximizing the fluid circulation rate. In a very simple construction, this can be achieved by creating the shroud 180 out of a single solid material that has a low coefficient of thermal conductivity. However, it must be considered that the material should neither degrade nor deform under the operating temperatures and pressures of the heat exchanger 20. Thus, in one preferred embodiment, the low coefficient of thermal conductivity of the shroud 80 is achieved by making the shroud 180 as a multi-layer construction. Of course, when the shroud 180 is made of a multi-component construct, it is the effective coefficient of thermal conductivity of the shroud 180 that is preferably less than the coefficient of thermal conductivity of the shell-side liquid. Of course, the same principle applies to the shell-side liquid if it were a multi-component solution or mixture.

Referring now to FIG. 5*a*, a cross-sectional view of the shroud 180, which is a multi-layered construct, is illustrated. The shroud 180 comprises a first inner plate 183 that is adjacent to the U-tube bundle 130 and a second outer plate 184 that is adjacent to the inner surface 112 of the shell 110. The first and second plates 183, 184 are preferably made of a material that is highly resistant to corrosion, such as stainless steel. The first and second plates 183, 184 are separated by a thermal insulating layer 185 so that the heat from the first plate 183 is not effectively transferred to the second plate 184. By maintaining the thermal insulating layer 185 between the first and second plates 183, 184, the circulation of the shell-side fluid by natural thermosiphon flow is not effectuated. The thermal insulating layer 185 is preferably a hermetically sealed gap that is filled with a non-reactive gas, such as an inert gas, nitrogen, helium or the like. Of course, any gas or other thermal insulating material can be used. In order to maintain the gap between the first and second plates 183, 184, a spacer 186 comprised of a poor thermally conducting material, such as, for example, plastic, is positioned between the first and second plates 183, 184.

Referring now to FIGS. 6-8 concurrently, a description of the stabilizing plates 140 will be undertaken. As mentioned above, the stabilizing plates 140 comprise a lattice structure 165 having openings 141 through which the U-tubes 131 of the tube bundle 130 extend and are supported. The stabilizing plates 140 generally comprises a ring-like peripheral frame 142 forming a central opening and a lattice structure 165 disposed within and filling this central opening. The lattice structure 165 comprises a first set of thin parallel linear strips 145 and a second set of thin parallel linear strips 146. The first set of strips 145 intersects with the second set of strips 146 so as to form a gridwork within the peripheral frame 142. The first and second sets of parallel strips 145, 146 are preferably thin, flat strips having major surfaces that extend substantially parallel to the longitudinal axis A-A when the stabilizing plates 140 are installed within the heat exchanger 20.

The first and second sets of parallel strips 145, 146 of the lattice structure 165 intersect to form a honeycomb-like arrangement of rhombus shaped openings 141. Of course, the invention is not limited to rhombus shaped openings and other shaped openings, such as, for example, other quadrilateral, parallelogram, and/or prismatic shaped openings are contemplated and within the scope of the present invention. Furthermore, although the openings 141 are described as being rhombus shaped, the four sides of the openings 141 need not be of equal length. Any size and shaped openings may be used as long as the U-tubes 131 are stabilized within the openings 141 and a sufficient portion of the openings 141 remain unobstructed by the U-tubes 131 to enable axial flow of the shell-side liquid as will be described below.

Each rhombus shaped opening 141 comprises two diagonals, namely a major diagonal 143 that extends from a top corner 147 to a bottom corner 148 of the opening 141 and a minor diagonal 144 that extends between two side corners 149, 160 of the opening 141. As such, the major and minor diagonals are substantially perpendicular to one another. The major diagonal 143 is larger than the minor diagonal 144. It should be noted that the orientation of the opening 141 could of course be rotated as desired.

The U-tubes 131 fit within the rhombus shaped openings 141 such that portions of the outer surface of the U-tubes 131 contact portions of the parallel strips 145, 146. Specifically, portions of the parallel linear strips 145, 146 tangentially contact the contoured outer surface 161 of the tubes 131 of the tube bundle 130. Because the U-tubes 131 have a circular cross-section and the openings 141 are rhombus shaped, a vastly substantial portion of the outer surface 161 of the U-tubes 131 is not in contact with the parallel strips 145, 146. Instead, in the exemplified embodiment, there are only four points of contact between the outer surface 161 of the U-tubes 131 and the parallel strips 145, 146. Of course, the term "points of contact" is not limited strictly limited to a "point," but rather is a "line" due to the tubes 131 and the strips 145, 146 having an axial length. There are four separate parallel strips 145, 146 that make up each opening 141. The outer surface 161 of the U-tube 131 within each opening 141 has a point of contact with each of the four parallel strips 145, 146 that makes up the opening 141.

Furthermore, there are minor gaps 162 between the outer surface 161 of the U-tubes 131 and the parallel strips 145, 146 along the direction of the minor diagonal 144 and major gaps 163 between the outer surface 161 of the U-tubes 131 and the parallel strips 145, 146 along the direction of the major diagonal 143. These major and minor gaps 162, 163 remain unobstructed by the U-tubes 131 when the U-tubes 131 are positioned within the openings 141 of the lattice structure 165 in order to promote and allow axial flow of the shell-side fluid through the openings 141 with minimal pressure loss. Although the major gap 163 is shown as being a larger space than the minor gap 162, the relative sizes of the major and minor gaps 162, 163 may change depending on the relative sizes of the major and minor diagonals 143, 144.

The axial flow of the shell-side fluid through the unobstructed portions of the openings 141 is driven by the axially varying temperature difference between the hot oil flowing through the U-tube bundle 130 and the shell-side fluid flowing through the cavity 113 of the shell 110. This axial flow of the fluid further improves the boiling rate. Furthermore, the axial flow of the shell-side fluid prevents oxidation products and sludge from depositing in the crevices at the tube support locations, which has been known to cause the demise of numerous steam generators in nuclear plants in the past.

The stabilizing plate 140 shown in FIGS. 6-7 is shown as one unitary disk-shaped plate formed by a peripheral frame 142 that encloses the lattice structure 165. However, FIG. 8 shows an embodiment of the stabilizing plate 140 that comprises two distinct semicircular plates 171, 172 separated by a space 173. The embodiment of FIG. 8 may be preferred in order to maintain a separation between the hot leg 108 and the cool leg 109 of the U-tube bundle 130. Such a separation will promote the natural thermosiphon flow of the shell-side fluid.

Figure 9:
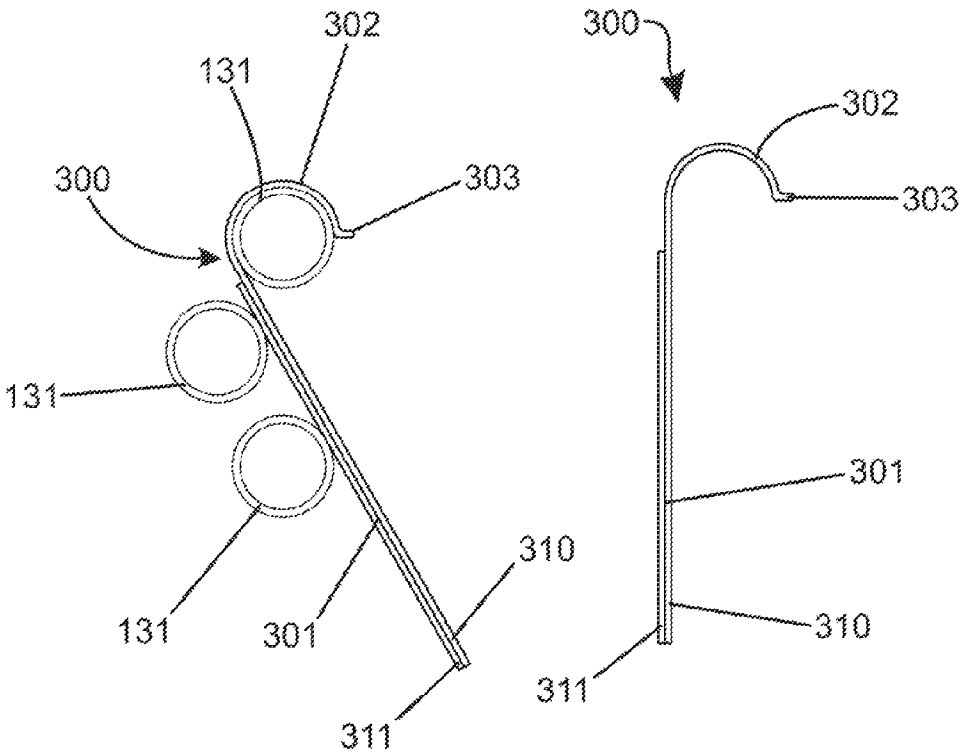
FIG. 9 is a side view of a flexible stake according to one embodiment of the present invention.

Referring now to FIG. 9, a tube stake 300 in accordance with an embodiment of the present invention is illustrated. In a typical heat exchanger, vibration of the U-tubes is of utmost concern. Specifically, heat exchanger tube bundles may fail due to excessive vibration or noise generated by the shell-side fluid that passes around and between the tubes. In the present invention, the bight portions 132 of the U-tubes 131 have a natural fundamental frequency in excess of 40 Hz and may be more susceptible to flow induced vibration and, therefore, failure. Therefore, the U-tubes 131 with a natural fundamental frequency in excess of 40 Hz are preferably restrained by the flexible stakes 300. The flexible stakes 300 comprise a J-shaped structure having a straight portion 301 and a J-bend portion 302. The J-bend portion 302 is preferably flexible so that a U-tube 131 can be tightly held therein. The straight portion 301 preferably comprises two layers of material 310, 311 in order to add structural rigidity to the straight portion 301 of the tube stake 300 in this way, the tube stake 300 will securely retain the U-tubes 131 in place and prevent flow induced vibration from causing the U-tubes 131 to fail.

The flexible stakes 300 may be attached to the U-tubes 131 by a snap fit connection by stretching the flexible J-bend portion 302 so that the U-tubes 131 will fit therein and then allowing the J-bend portion 302 to conform to and tightly retain the U-tubes 131. In order to assist with removing the flexible stakes 300 from the U-tubes 131, the end of the J-bend portion 302 comprises a flange 303. The flange 303 enables a user or a machine to create sufficient space between the U-tube 131 and the flexible stake 300 so that the U-tube 131 can be removed therefrom. Of course, the invention is not limited to a snap fit connection between the flexible stakes 300 and the U-tubes 131 and other types of attachment are contemplated within the scope of the present invention, such as, for example, threaded screw, bolt, welding or the like.

The flexible stakes 300 can be positioned in various locations throughout the cavity 113 as needed. For example, if a particular U-tube 131 is more susceptible to vibration caused failure, more than one flexible stake 300 may be attached to the U-tube 131 in order to further secure it and prevent it from vibrating. The other ends of the flexible stakes 300 are secured to a stable structure to prevent unwanted vibration.

Figure 10:
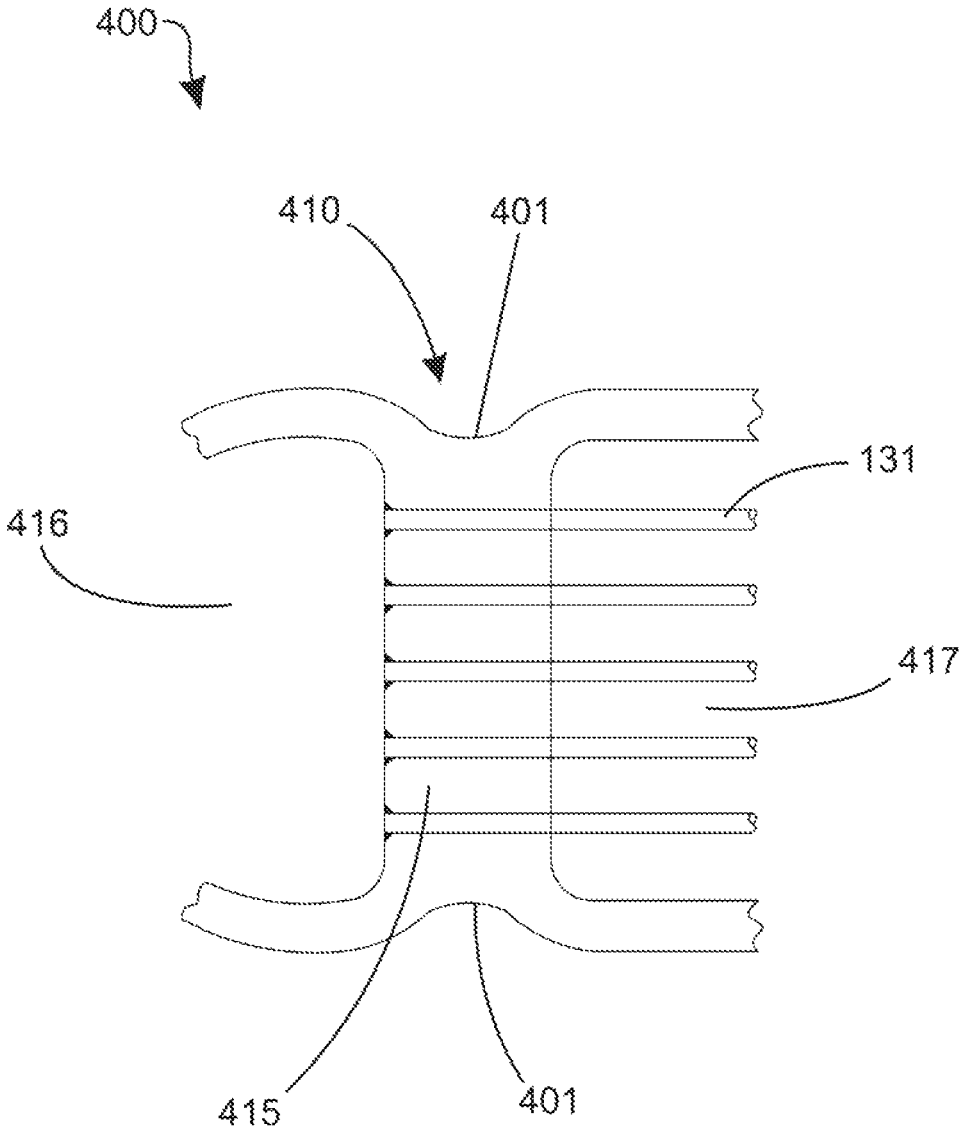
FIG. 10 is a longitudinal cross-sectional schematic of a scalloped tube sheet according to one embodiment of the present invention.

Referring now to FIG. 10, a scalloped tube sheet 400 in accordance with an embodiment of the present invention will be described. The scalloped tube sheet 400 may be incorporated into the heat exchanger 20 as desired to deal with thermal transients. The junction 410 between the tube-side chamber 416, the tube sheet 415 and the shell-side chamber 417 is a location of high rigidity and high thermal stress. Therefore, the present invention improves the structural flexibility of the junction 410 by creating a groove 401 in the tube sheet 400. The groove 401 is essentially an area of the tube sheet 400 that is thinned in comparison to the rest of the tube sheet 400. The groove 401 substantially eliminates the solid outer portion of tube sheets used in conventional heat exchangers. The groove 401 will allow a steam generator that uses the scalloped tube sheet 400 to withstand thermal transients caused by the daily rapid ramp-up and ramp-down that is required in solar power plants. In other words, the groove 401 allows the scalloped tube sheet 400 to expand and contract freely when experiencing thermal cycling and thermal transients. A further discussion of a scalloped tube sheet is discussed in United States Patent Application Publication No. 2008/0314570, filed on May 27, 2008, the entirety of which is hereby incorporated by reference.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A heat exchanger apparatus for converting a shell-side liquid to a vapor comprising:

a shell having an inner surface forming a cavity, the shell comprising an inlet for introducing the shell-side liquid into the cavity and an outlet for allowing the vapor to exit the cavity;

a tube bundle comprising a plurality of tubes for carrying a tube-side fluid located in the cavity and having a longitudinal axis;

a shroud circumferentially surrounding the tube bundle and positioned between the tube bundle and the inner surface of the shell so that an annular space exists between the shroud and the inner surface of the shell, wherein the shroud comprises a first plate and a second plate separated by a thermal insulating layer;

an opening in a bottom portion of the shroud that forms a passageway between the annular space and the rube bundle; and an opening in a top portion of the shroud that forms a passageway between the annular space and the tube bundle.

2. The heat exchanger apparatus of claim 1 wherein the shroud has an effective coefficient of thermal conductivity that is less than a coefficient of thermal conductivity of the shell-side liquid.

3. The heat exchanger apparatus of claim 1 wherein the thermal insulating layer is a hermetically sealed cap formed between the first and second plates and filled with a gas.

4. The heat exchanger apparatus of claim 1 further comprising a stabilizing plate positioned within the cavity and arranged in a substantially transverse orientation, the stabilizing plate comprising a lattice structure having openings for stabilizing the tube bundle, wherein the tubes of the tube bundle extend through the openings formed by intersecting members of the lattice structure.

5. The heat exchanger apparatus of claim 4 wherein the openings of the lattice structure are sized and shaped so that the tubes contact the intersecting members and a portion of the openings remain unobstructed by the tubes, thereby allowing axial flow of the shell-side liquid along the tubes while transversely retaining the tubes.

6. The heat exchanger apparatus of claim 5 wherein the openings of the lattice structure have a rhombus shape having a. major diagonal and a minor diagonal, the major diagonal being larger than the minor diagonal.

7. The heat exchanger apparatus of claim 1 further comprising:

a lattice structure for stabilizing, the tube bundle, wherein tubes of the tube bundle extend through openings formed by intersecting members;

wherein the tubes are transversely retained by the intersecting members of the lattice structure; and wherein a portion of the openings remain unobstructed by the tubes to allow the shell-side liquid to flow through the lattice structure in a direction of the longitudinal axis.

8. The heat exchanger apparatus of claim 1 wherein the shroud comprises a first arcuate section and a second arcuate section positioned on opposite lateral sides of the tube bundle.

9. The heat exchanger apparatus of claim 8 wherein the opening in the bottom portion of the shroud is formed between a bottom edge of the first arcuate section and a bottom edge of the second arcuate section and wherein the opening in the top portion of the shroud is formed between a top edge of the first arcuate section and a top edge of the second arcuate section.

10. The heat exchanger apparatus of claim 1 wherein the inlet is positioned on the shell to introduce the shell-side liquid into the annular space.

11. The heat exchanger apparatus of claim 10 wherein the outlet is located in a top portion of the shell.

12. The heat exchanger apparatus of claim 11 further comprising a means for maintaining a. level of the liquid within the shell at a height above the shroud and the tube bundle and below the outlet.

13. The heat exchanger apparatus of claim 12 further comprising a drip tray positioned in the cavity between the outlet and the liquid level.

14. A heat exchanger apparatus for converting a shell-side liquid to a vapor comprising:

a shell having, an inner surface forming a cavity, the shell comprising, an inlet for introducing the shell-side liquid into the cavity and an outlet located in a top portion of the shell for allowing the vapor to exit the cavity, wherein the inlet is positioned on the shell to introduce the shell-side liquid into the annular space;

a drip tray positioned in the cavity between the outlet and the liquid level;

a first moisture separator positioned within the outlet; and a second moisture separator positioned in the cavity between the drip tray and the outlet;

a tube bundle comprising a plurality of tubes for carrying a tube-side fluid located in the cavity and having a longitudinal axis;

a shroud circumferentially surrounding the tube bundle and positioned between the tube bundle and the inner surface of the shell so that an annular space exists between the shroud and the inner surface of the shell;

an opening in a bottom portion of the shroud that forms a passageway between the annular space and the tube bundle;

an opening in a top portion of the shroud that forms a passage way between the annular space and the tube bundle; and a means for maintaining, a level of the liquid within the shell at a height above the shroud and the tube bundle and below the outlet.

15. The heat exchanger apparatus of claim 1 wherein the shell-side liquid is water and the tube-side fluid is hot oil.

16. The heat exchanger of claim 1 further comprising a plurality of transversely oriented partition plates that divide the cavity into longitudinal sections, and wherein tubes of the tube bundle extend through the partition plates, and wherein each of the partition plates comprise one or more flanges extending transversely from an edge, the partition plates passing through slots in the shroud, a portion of the flanges extending from an outer surface of the shroud and secured to the shell.

17. The heat exchanger of claim 1 wherein the tube bundle comprises a plurality of U-tubes having a hot leg and cool leg, wherein the hot leg is above the cool leg so that the cool leg is adjacent the opening in the bottom portion of the shroud and the hot leg is adjacent the opening in the top portion of the shroud.

18. A heat exchanger apparatus for converting a shell-side liquid to a vapor comprising:

a shell having a cavity, the shell comprising an inlet for introducing the shell-side liquid into the cavity and an outlet for allowing the vapor to exit the cavity;

a tube bundle positioned in the cavity and comprising a plurality of tubes for carrying a hot tube-side fluid;

a thermal insulating barrier positioned between the tube bundle and the shell so that a space exists between the thermal insulating barrier and the shell, an opening in a bottom portion of the thermal insulating barrier that forms a passageway between the space and the tube bundle, an opening in a top portion of the thermal insulating barrier that forms a passageway between the space and the tube bundle;

wherein heat emanating from the tube bundle causes a natural cyclical thermosiphon flow of the shell-side liquid within the cavity;

and further comprising:

the inlet positioned on the shell to introduce the shell-side liquid into the space;

the outlet is located in a top portion of the shell;

means for maintaining a level of the shell-side liquid within the cavity that submerges the thermal insulating barrier and the tube bundle;

a drip tray positioned in the cavity between the outlet and the liquid level;

a first moisture separator positioned within the outlet; and a second moisture separator positioned in the cavity between the drip tray and the outlet.

19. The heat exchanger apparatus of claim 18 wherein the natural cyclical thermosiphon flow comprises:

(i) an upward flow of the shell-side liquid through the tube bundle and out of the opening in the top portion of the thermal insulating barrier;

(ii) a downward flow of the shell-side liquid through space; and (iii) an upward flow the shell-side liquid from the space through the opening in the bottom portion of the thermal insulating, barrier to the tube bundle.

20. The heat exchanger apparatus of claim 19 wherein the tube bundle comprises a plurality of U-tubes having a hot leg and cool leg, wherein the hot leg is above the cool leg so that the cool leg is adjacent the opening in the bottom portion of the thermal insulating barrier and the hot leg is adjacent the opening in the top portion of the thermal insulating barrier.

21. The heat exchanger apparatus of claim 20 wherein the thermal insulating barrier comprises a first section and a second section positioned on opposite lateral sides of the tube bundle.

22. The heat exchanger apparatus of claim 19 wherein the thermal insulating barrier has an effective coefficient of thermal conductivity that is less than a coefficient of thermal conductivity of the shell-side liquid.

* * * * *